United States Patent [19]

Roscart

[11] Patent Number: 4,943,044

[45] Date of Patent: Jul. 24, 1990

[54] RAILS OF AN INSERTER MACHINE

[76] Inventor: Charles W. Roscart, R.D. 1, Box 168-C, Imperial, Pa. 15126

[21] Appl. No.: 111,665

[22] Filed: Oct. 23, 1987

[51] Int. Cl.[5] ..... B65H 9/04

[52] U.S. Cl. ..... 271/248; 193/2 A

[58] Field of Search ..... 271/248, 253, 255; 226/196, 199; 193/2 A, 2

[56] References Cited

U.S. PATENT DOCUMENTS

| | | | |
|---|---|---|---|
| 2,536,961 | 1/1951 | Smith | 198/600 X |
| 2,569,711 | 10/1951 | Foster | 198/539 X |
| 3,073,430 | 1/1963 | Quinn | 198/600 |
| 3,692,223 | 9/1972 | Laigle | 226/199 |
| 3,823,860 | 7/1974 | Perry | 226/199 |
| 4,270,748 | 6/1981 | Ray | 193/2 A X |
| 4,685,793 | 8/1987 | Sawada | 271/253 |

*Primary Examiner*—Richard A. Schacher
*Attorney, Agent, or Firm*—H. Jay Spiegel

[57] ABSTRACT

Disclosed herein is a device designed to be added to an existing machine to improve its efficiency and reduce errors. The existing machine is an inserter machine which is composed of several stations having guide rails connecting the stations. The machine is designed to feed papers from station to station along the guide rails, however gaps between the rails of adjacent stations cause the papers to catch and misalign thereby disrupting proper operation of the machine. The present invention consists of rail structures designed to overlie the guide rails of the existing machine in a manner covering the above described gaps so as to facilitate the smooth flow of papers from station to station without disruption.

9 Claims, 3 Drawing Sheets

11"
63
53
51
50
15"
59
17"
57
56
60
55
28
13"
27"
70
31"
29"
61
2
9
4
5
4a
2a
62

RAILS OF AN INSERTER MACHINE

BACKGROUND OF THE INVENTION

The present invention relates to an improvement in the rails of an inserter machine. The present invention is specifically designed to be applied to an existing machine known in the prior art as an inserting machine. An example of such a machine is made by Muller Martini AG and the machine includes an elongated length of guide rails divided up into a plurality of stations which are traversed by paper products which move under the operation of the machine. Between adjacent stations, the machine, as manufactured, includes a pronounced gap between the adjacent guide rails which is sufficiently wide so as to cause papers which are being conveyed by the machine to become caught therein thus resulting in jamming of the machine. Such jamming results in large levels of down time for the machines, increases in labor costs since longer periods of time must be spent on each job including down time, and other expenses accrue such as for example loss of materials due to jamming, increased labor costs due to the requirement of repairing the machine after each mishap and the like.

Thus, a need has developed for a modification to inserting machines which will prevent the above described problems from occurring.

Applicant is aware of U.S. Pat. Nos. 765,882 to Coburn and 1,002,498 to Carlson. Each of these patents discloses a device designed to overlie a gap between adjacent sections of a railway rail. The present invention is believed to clearly distinguish from the teachings of these patents since the present invention is intended to be used in a completely different environment from that which is disclosed in these patents, and, further, since the present invention is of different structure, function and mode of installation than the devices taught in these patents.

SUMMARY OF THE INVENTION

The present invention includes the following aspects and features:

(a) In a first embodiment of the present invention, the prior art inserting machine may include a structure including a gathering track, a guide rail defining one side of the gathering track and an add-on angle designed to narrow the gathering track for narrower copy. The gap between adjacent stations is covered by the inventive rail addition and is attached thereto through the provision of a screw threaded into a threaded hole formed in the surface of the gathering track.

(b) In a second embodiment of the present invention, the rail attachment is attached to the existing structure in overlying relation to the gap between adjacent stations through the provision of an added tab section extending in a direction parallel to the surface of the gathering track. In assembling the rail attachment in overlying relation to the gap and the gathering track, the above described add-on angle is loosened and the tab structure is placed thereunder, whereupon the add-on angle is tightened to hold the rail attachment in assembly.

(c) In a third embodiment of the present invention, where wider copy is to be operated upon by the inserting machine, the add-on angle may be removed leaving a wider gathering track. In such a circumstance, the rail attachment is modified to provide a different tab structure lying in a plane substantially parallel to the plane of the surface which overlies the gathering track and a plurality of screws are utilized to removably attach the rail attachment in overlying relation to both the surface of the gathering track and the guide rail as well as the gap between adjacent stations.

Accordingly, it is a first object of the present invention to provide an improvement in the rails of an inserter machine.

It is a further object of the present invention to provide such an improvement including a rail attachment device designed to be detachably mountable over the gathering track of an existing guide way.

It is a still further object of the present invention to provide such a device which covers any gap between adjacent stations in such a manner that paper traversing the gathering track may not be caught or hung up on such gaps.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
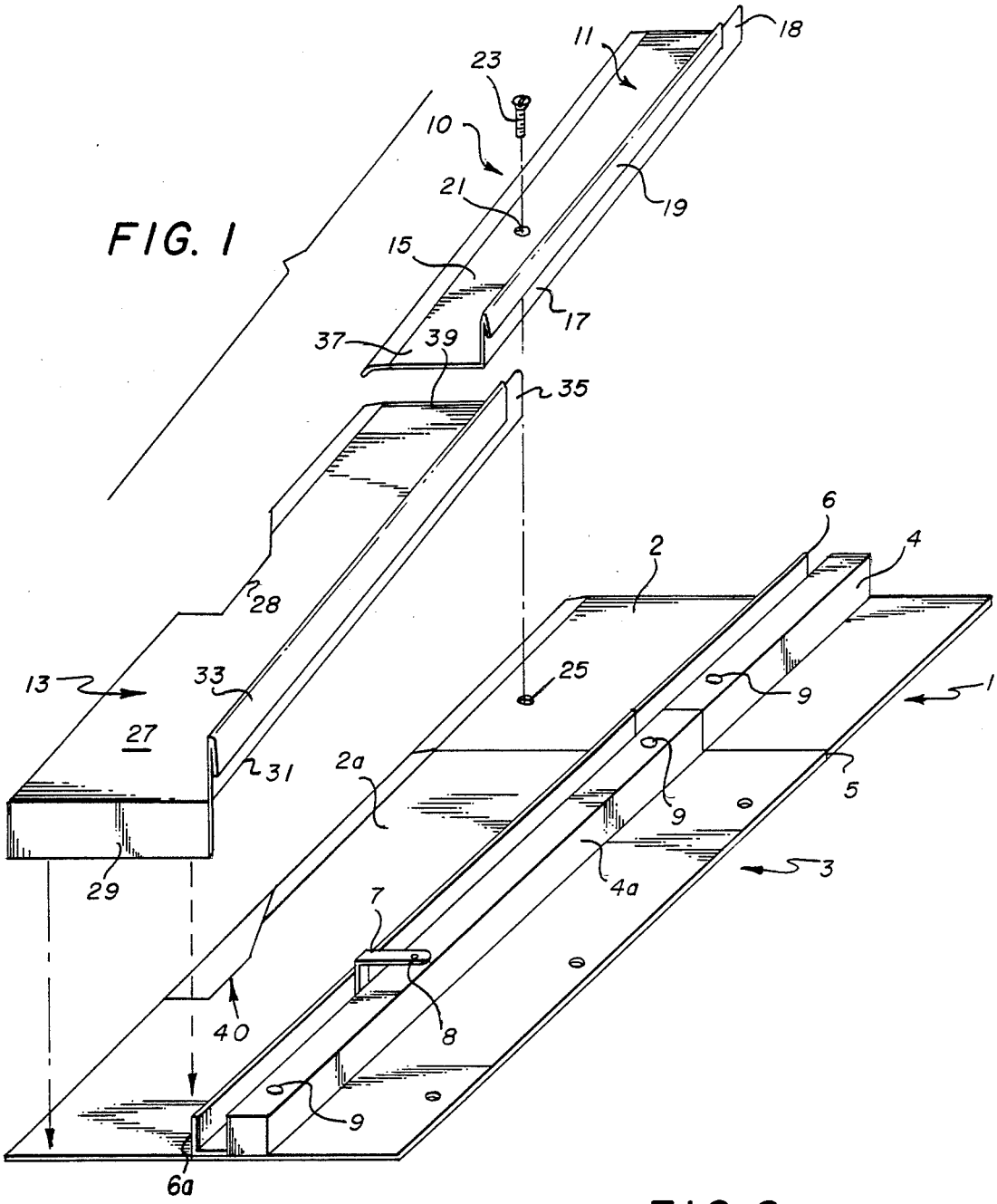
FIG. 1 shows an exploded perspective view of a first embodiment of the present invention.
Figure 2:
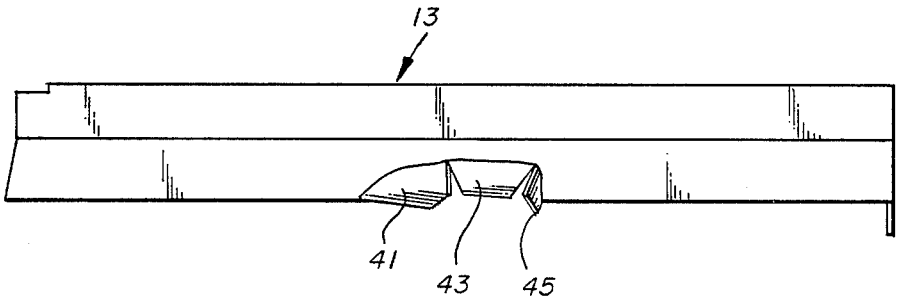
FIG. 2 shows a side view of a portion of the structure shown in FIG. 1.

With reference, first, to FIGS. 1 and 2, a first embodiment of the present invention will be explained. In FIG. 1, a small portion of the entirety of the length of an inserting machine is shown including the interface area between two adjacent stations thereof.

With particular reference to FIG. 1, a first station 1 and a second station 3 are seen to be separated by a pronounced gap 5 therebetween. The station 1 includes a gathering track 2, a guide rail 4 and an add-on angle 6. Similarly, the station 3 includes a continuation of the gathering track **2*a*, and continuation of the guide rail 4*a* and a continuation of the add-on angle 6*a*. As seen in FIG. 1, the add-on angle 6*a* is detachably mounted on the guide rail 4*a* by virtue of an angular connector 7 detachably connected to the guide rail 4*a* through the use of a screw 8. Similar structure (not shown) is utilized to detachably hold the angle iron 6 onto the guide rail 4. Furthermore, the guide rails 4, 4*a* are detachably mounted to the surface of the gathering track 2, 2*a* by virtue of screws 9**.

The present invention is generally designated by the reference numeral 10 and comprises an attachment device including two rail attachments 11 and 13 which may be termed attachment devices. As seen in FIG. 1 in particular, the rail attachment 11 consists of a flat surface 15 designed to overlie the gathering track 2, an upstanding surface 17 and a folded over surface 19 which lies adjacent the surface 17 and extends only partly toward the surface 15. An opening 21 is formed in the surface 15 of the rail attachment 11 and a screw 23 is utilized to attach the section 11 to the gathering track 2 by virtue of a threaded hole 25 therein.

The rail attachment section 13 consists of a surface 27 designed to overlie the surface of the gathering track 2a, an end tab 29 depending downwardly therefrom and designed to overlie the end of the gathering track 2a in the situation where the gathering track 2a is the last one in a series thereof, a vertical portion 31 and a folded over portion 33 extending part of the distance back toward the surface 27.

As seen in FIG. 1, the surfaces 31 and 17 include respective rear portions 35 and 18 which are designed to facilitate the coupling of adjacent rail attachment sections together. The exposed areas 35 and 18 are formed by shortening of the folded over portions 33 and 19 and, in assembly of the sections 11 and 13 together, the portion 35 is inserted between the wall 17 and the folded over portion 19 and thus, with the sections 11 and 13 assembled together, the downstream end 37 of the surface 15 will lie in overlying relation to the upstream end 39 of the surface 27. Since the direction of movement of paper products flowing over the gathering tracks is in the direction from the attachment section 11 to the attachment section 13, this overlap will prevent the problems which exist in the inserting machine as manufactured.

With further reference to FIGS. 1 and 2, it is seen that one characteristic of the prior art inserting machine is a recess in the gathering track generally designated by the reference numeral 40. In order to ensure smooth movement of papers along the gathering track, the surface 27 of the attachment section 13 is provided with a corresponding cut-away portion 28 best seen in FIG. 2 to have depending downwardly therefrom three sections 41, 43 and 45 which are bent downwardly as seen in FIG. 2 so as to not interfere with the surface 27.

In situations where the gathering track 2a is not the terminal gathering track, the tab 29 of the section 13 is omitted and, the next section (not shown) is coupled to the section 13 in the manner described hereinabove with respect to the coupling of the sections 11 and 13.

Figure 3:
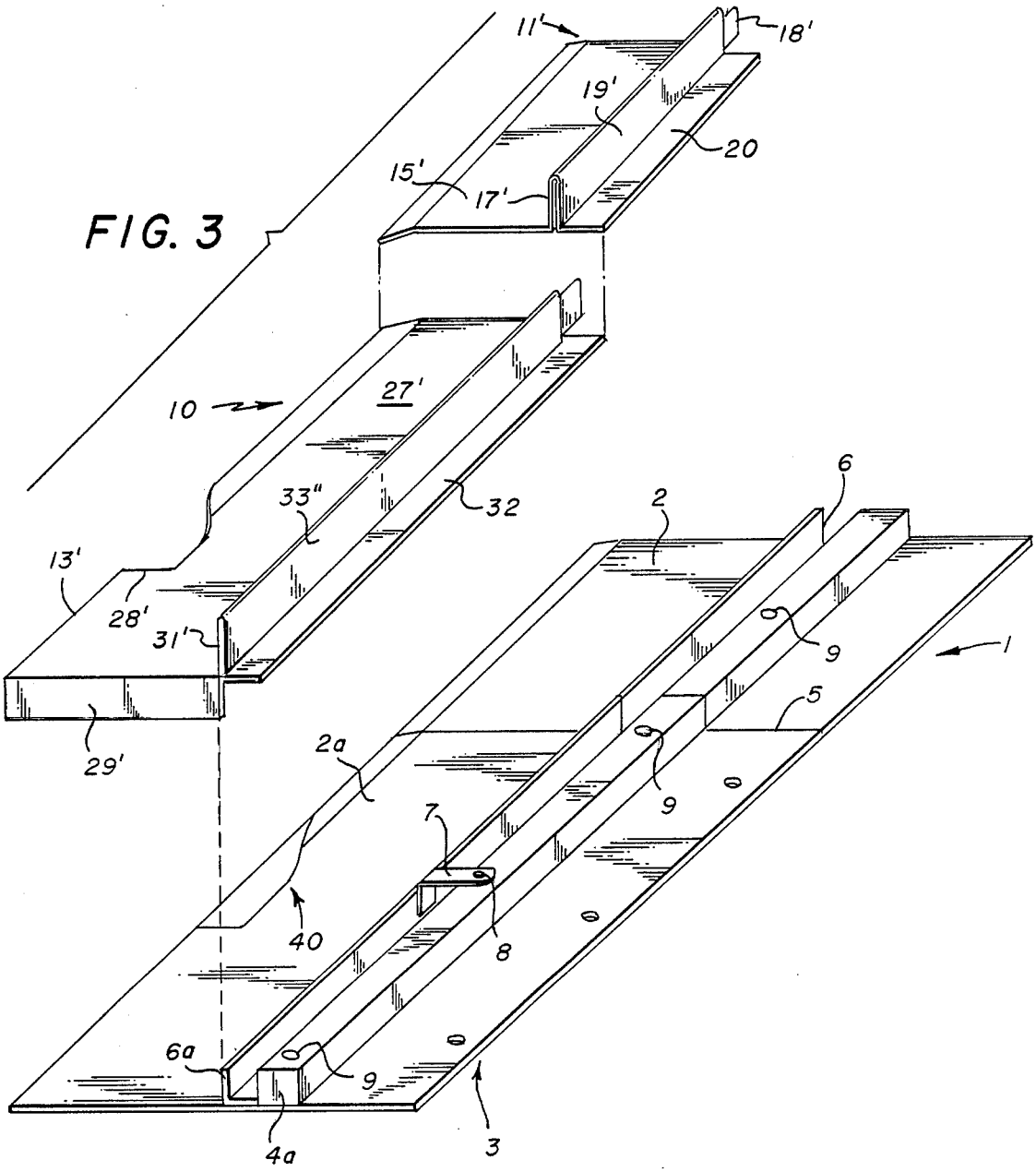
FIG. 3 shows an exploded perspective view of a second embodiment of the present invention.
Figure 4:
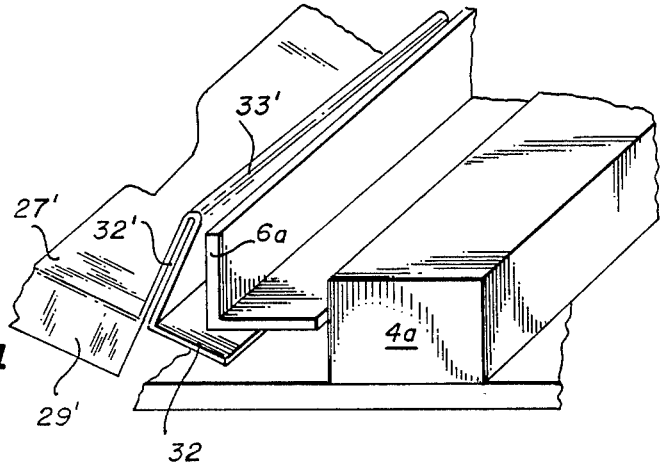
FIG. 4 shows a perspective view of the embodiment of FIG. 3, showing an assembly detail.

With reference now to FIGS. 3 and 4, a second embodiment of the present invention will be explained, and like elements will be designated with like, primed, reference numerals.

With reference to FIG. 3, firstly, all of the elements of the gathering track, guide rail and add-on angle are the same as those depicted in FIG. 1 except that the hole 25 in the gathering track 2 does not exist in the embodiment of FIGS. 3 and 4.

With particular reference to FIG. 3, it is seen that the attachment device comprises on attachment section 11' including a surface 15', an upstanding wall 17' and a folded over wall 19' which extends all the way down to the level of the surface 15' and has attached thereto a horizontal elongated tab 20 which is coplanar with the major portion of the surface 15'. The surface 17' includes a rearwardly extending portion 18'.

The attachment section 13' includes a surface 27', notch structure 28', a depending tab 29', a vertical wall 31', a folded over vertical wall 33' depending downwardly and terminating at the level of the surface 27' and having extending outwardly therefrom a tab section 32 which is substantially coplaner with the major portion of the surface 27'.

The sections 11' and 13' are assembled together in the same manner as the sections 11 and 13 described hereinabove with reference to FIGS. 1 and 2. The provision of the tabs 20 and 32 eliminates the necessity of using the fastening device 23 and the hole 25 in assembling the device 10' to the gathering track 2, 2a. In this regard, reference is made to FIG. 4 wherein it is seen that the add-on angle 6a has been loosened by loosening the screw 8 so that the elongated tab 32 may be inserted under the add-on angle 6a, whereupon the add-on angle 6a may be reinstalled in the manner seen in FIG. 3 so as to rigidly affix the section 13' in assembled relation thereon. Similarly, the section 11' is installed by insertion of the elongated tab 20 under the loosened add-on angle 6. Through the provision of this structure, the necessity for the screw 23 and hole 25 as seen in FIG. 1 is eliminated.

Figure 5:
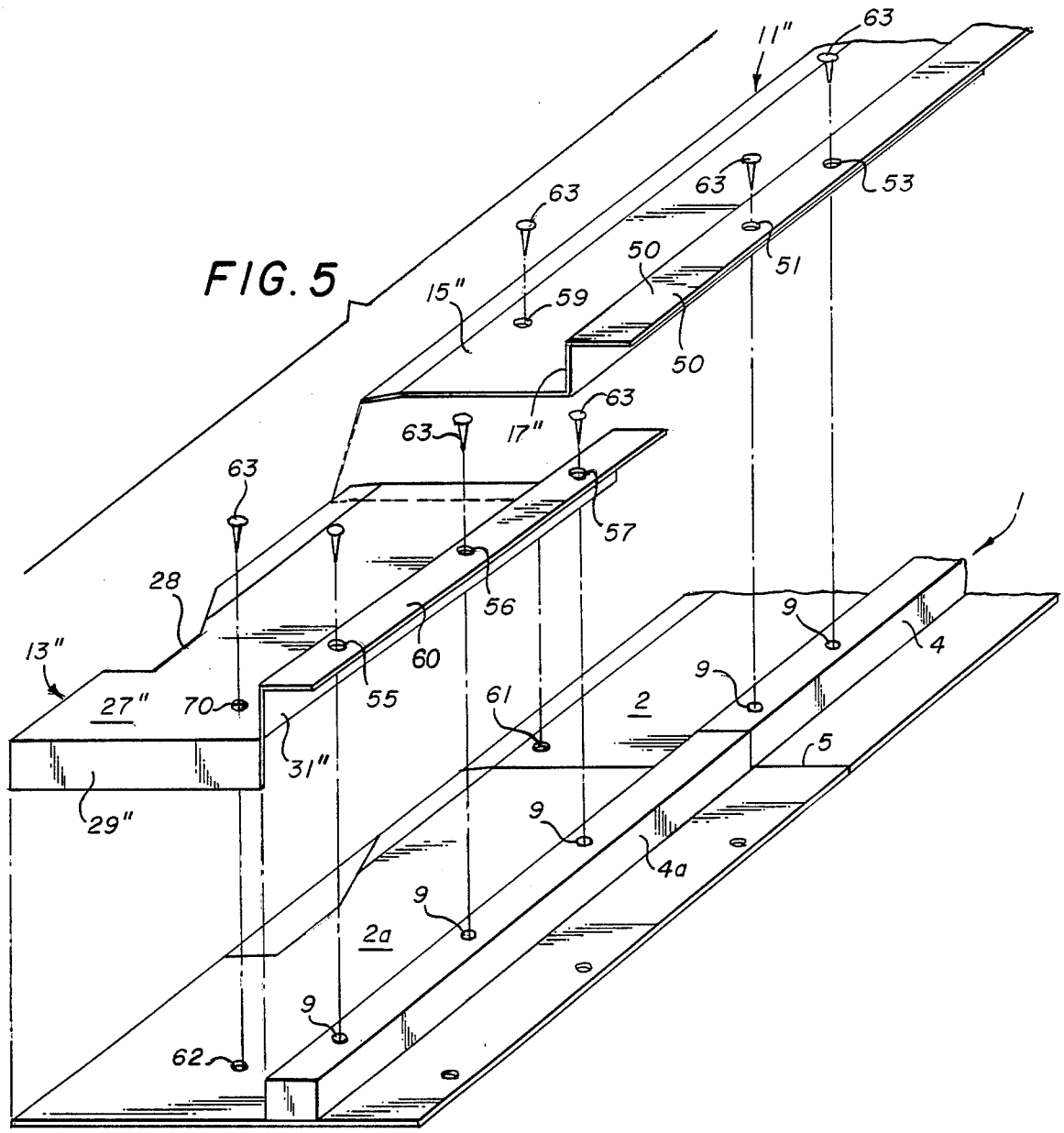
FIG. 5 shows an exploded perspective view of a third embodiment of the present invention.

With reference now to FIG. 5, a further embodiment of the present invention is seen wherein the details of the gathering track and the guide rail are in most respects identical to the structures seen in FIGS. 1 and 3. Elements of the attachment devices which are the same as in the attachment devices in the prior figures are designated by like, double primed, reference numerals.

As seen in FIG. 5, the add-on angle 6, 6a has been eliminated so that the gathering track may be utilized in transporting wider papers. Thus, the present invention 10'' must be provided with wider surfaces of engagement over the gathering track 2, 2a. Furthermore, the means of attachment of the device 10'' to the machine 1 must be altered. Thus, the attachment section 11'' is seen to include a surface 15'' which is sufficiently wide to traverse the entirety of the gathering track 2 including the surface vacated by removal of the add-on angle 6. The vertical wall 17'' is provided but the folded over section 19 has been replaced with a horizontal wall 50 designed to overlie the top of the guide rail 4 with the wall 17'' being designed to overlie the wall of the guide rail 4 which faces the surface of the gathering track 2. As seen, holes 51, 53 are provided in the surface 50 which align with respective holes 9 in the top surface of the guide rail 4. Similarly, a hole 59 in the surface 17'' aligns with a hole 61 formed in the gathering track 2. Screws 63 are utilized to hold the attachment section 11'' in assembled relation over the gathering track 2.

The attachment section 13'' includes the notch 28'' and a tab 29'' as well as a surface 27'' which is sufficiently wide so as to overlie the entirety of the width of the gathering track 2a which is wider than that which is seen in the embodiments of FIGS. 1 and 3 by virtue of the elimination of the add-on angle.

In the attachment section 13'', the vertical wall 31'' is provided, however, the folded over wall 33 in the embodiment of FIG. 1 has been replaced with a horizontal wall 60 which is parallel to substantially the entirety of the surface 27''. Holes 55, 56 and 57 in the wall 60 are designed to align with holes 9 in the guide rail 4a and screws 63 are utilized to detachably attach the section 13' in assembled relation over the gathering 2a. Similarly, a screw 63 extends through a hole 70 in the surface 27'' and is threaded into a hole 62 formed in the gathering track 2a to assemble the section 13'' to the gathering track 2a.

As should be understood from FIG. 5, when the 2 rail sections are assembled over the gathering track 2, 2a the overlap is in the direction of flow of the papers thereby eliminating the problems which exist in the unmodified machine 1. Structure analogous to the elements 18 and 35 as seen in FIG. 1 is not present in the embodiment shown in FIG. 5 since there is no slot structure formed by fold over structures which would enable such structure to be useful in holding the adjacent attachment sections together.

As should be understood, the attachment sections disclosed hereinabove may be made of any rigid but pliable material such as aluminum or sheet steel. The sections must be made thin enough so that they do not significantly disrupt the smooth surface of the gathering track which exists from station to station save for the gaps 5 between adjacent sections which are eliminated through the teachings of the present invention. Through the use of the present invention, the prior art inserting machine may be operated for longer periods of time without maintenance, repair and recalibration, and labor costs as well as production costs are significantly reduced.

Accordingly, an invention has been disclosed in terms of preferred embodiments thereof which fulfill each and every one of the objects of the invention as set forth hereinabove. Of course, various changes, modifications and alterations of the teachings of the present invention may be contemplated by those skilled in the art without departing from the intended spirit and scope of the present invention. Accordingly, it is intended that the present invention only be limited by the terms of the appended claims.

I claim:

1. In a machine designed to feed papers from a first station having a first gathering track to a second station having a second gathering track, said gathering tracks having a gap therebetween, an attachment device comprising:

(a) an elongated body sized to overlie at least a portion of said first gathering track, at least a portion of said second gathering track and the entirety of said gap;

(b) first attachment means for attaching said attachment device in partial overlying relation to said first gathering track and second attachment means for attaching said attachment device in partial overlying relation to said second gathering track whereby papers being fed through said machine pass over said attachment device and are not caught in said gap; and (c) said elongated body comprising first and second body members which are releasably coupled together, said second gathering track being downstream of said first gathering track in a direction of movement of papers thereover, said first and second body members having overlapping structure with an upper portion of said overlapping structure being located on said first body member whereby smooth flow of papers thereover is substantially unimpeded by said overlapping structure.

2. The invention of claim 1, wherein said attachment device includes an upstanding wall extending longitudinally therealong, said first attachment means and second attachment means attaching said attachment device in partial overlying relation to said first and second gathering tracks via (1) said upstanding wall and (2) rail means adjacent said gathering tracks.

3. The invention of claim 2, wherein said first and second gathering tracks have attached thereover first and second angle devices which are aligned with one another and which narrow the width of said first and second gathering tracks through attachment to said first and second angle devices.

4. The invention of claim 3, wherein said upstanding wall has attached thereto a downwardly extending wall having attached thereto a transverse wall substantially coplanar with said elongated body, said transverse wall being attached to said first and second angle devices.

5. The invention of claim 4, wherein said first and second angle devices are respectively connected to said first and second gathering tracks through threaded fastening means, and said transverse wall is connected to said angle devices by loosening said threaded fastening means, inserting said transverse wall under said first and second angle devices and thereafter tightening said threaded fastening means.

6. The invention of claim 3, wherein said upstanding wall has attached thereto a transverse wall substantially parallel to said elongated body, said transverse wall being attached to said first and second angle devices by threaded fastening means.

7. The invention of claim 2, wherein said attachment device is attached to said first and second gathering tracks by threaded fasteners extending through said elongated body and through said rail means which comprises first and second guide rails mounted on said first and second gathering tracks.

8. The invention of claim 1, wherein said elongated body includes a cut-out portion including a plurality of tabs designed to interface with corresponding structure on one of said first and second gathering tracks.

9. In a machine designed to feed papers from a first station having a first gathering track to a second station having a second gathering track, said gathering tracks having a gap therebetween, an attachment device comprising:

(a) an elongated body sized to overlie at least a portion of said first gathering track, at least a portion of said gathering track and the entirety of said gap;

(b) first attachment means for attaching said attachment device in partial overlying relation to said first gathering track and second attachment means for attaching said attachment device in partial overlying relation to said second gathering track whereby papers being fed through said machine pass over said attachment device and are not caught in said gap;

(c) said attachment device including an upstanding wall extending longitudinally therealong, said first attachment means and second attachment means attaching said attachment device in partial overlying relation to said first and second gathering tracks via (1) said upstanding wall and (2) rail means adjacent said gathering tracks; and (d) said first and second gathering tracks having attached thereover first and second angle devices which are aligned with one another and which narrow the width of said first and second gathering tracks through attachment to said first and second angle devices.

* * * * *